US005786801A

United States Patent [19]

Ichise

[11] Patent Number: 5,786,801

[45] Date of Patent: Jul. 28, 1998

[54] BACK LIGHT CONTROL APPARATUS AND METHOD FOR A FLAT DISPLAY SYSTEM

[75] Inventor: Atsushi Ichise, Newport Beach, Calif.

[73] Assignees: Sony Corporation, Tokyo, Japan; Sony Transcom, Inc., Irvine, Calif.

[21] Appl. No.: 709,080

[22] Filed: Sep. 6, 1996

[51] Int. Cl.[6] ..... G09G 3/36

[52] U.S. Cl. ..... 345/102; 345/207

[58] Field of Search ..... 345/102, 207; 348/602, 603, 687, 834

[56] References Cited

U.S. PATENT DOCUMENTS

| | | | |
|---|---|---|---|
| 4,760,389 | 7/1988 | Aoki et al. | 345/102 |
| 4,788,588 | 11/1988 | Tomita | 348/602 |
| 4,952,117 | 8/1990 | Yabuuchi | 348/602 |
| 4,997,263 | 3/1991 | Cohen et al. | 345/207 |
| 5,105,186 | 4/1992 | May | 345/207 |
| 5,157,525 | 10/1992 | Eaton et al. | 345/207 |
| 5,164,849 | 11/1992 | Evans et al. | 345/102 |
| 5,270,818 | 12/1993 | Ottenstein | 348/687 |
| 5,315,695 | 5/1994 | Saito et al. | 345/77 |
| 5,337,073 | 8/1994 | Tsunoda et al. | 345/207 |
| 5,384,577 | 1/1995 | McLaughlin et al. | 345/102 |
| 5,406,305 | 4/1995 | Shimomura et al. | 345/102 |
| 5,485,172 | 1/1996 | Sawachika et al. | 345/102 |
| 5,488,434 | 1/1996 | Jung | 348/603 |
| 5,617,112 | 4/1997 | Yoshida et al. | 345/147 |
| 5,670,985 | 9/1997 | Cappels et al. | 345/207 |

*Primary Examiner*—Richard A. Hjerpe
*Assistant Examiner*—Ricardo Osorio
*Attorney, Agent, or Firm*—Pasquale Musacchio; Jerry A. Miller

[57] ABSTRACT

A backlight control method and apparatus adapted for use in, for example, aircraft passenger entertainment systems are described. The apparatus includes a present brightness/predetermined brightness and comparator, and a brightness controller which limits present brightness to a selected level in a system deployed in a discrete space (such as a passenger cabin) having a plurality of displays. The method includes steps of comparing present brightness and predetermined brightness and generating one or more control signals to control backlight brightness based on the comparison to provide more uniform brightness in a display system including many displays co-located in a common space.

15 Claims, 6 Drawing Sheets

BACK LIGHT CONTROL APPARATUS AND METHOD FOR A FLAT DISPLAY SYSTEM

FIELD OF THE INVENTION

The present invention generally relates to the back light control apparatus for flat display, such as liquid crystal display, more especially a plurality of the same type of such displays located in a discrete space, such as an aircraft passenger cabin.

BACKGROUND OF THE INVENTION

Personal service display systems for aircraft passengers (also known as inflight entertainment systems or IFEs) are known and increasingly prevalent in modern commercial aircraft. As can be seen, for example, in FIG. 1 or in U.S. Pat. Nos. 4,958,381 and 4,887,152, both co-assigned with this application, one method of providing personal service displays for aircraft passengers involves incorporating a liquid crystal display (LCD) into the back of a passenger seat where the display 1 may be viewed by the passenger immediately behind the seat containing the display. Various support arms for video displays which retract for stowage into the passenger's seat are also known. Finally, it is well known that flat displays such as LCDs often need a back light system in order to be viewed clearly in changing environmental circumstances, as is shown for example in U.S. Pat. Nos. 5,214,522 and 4,969,046, both co-assigned with this application. However, several difficulties exist which make known passenger personal service display systems less than optimal in their performance.

One problem with known systems is maintaining an acceptable level of perceived picture quality despite changing display space environments and over an extended period of use. It will be appreciated that in the area of display monitors, especially monitors provided for individual use in a space such as an aircraft passenger cabin wherein the background light level can fluctuate markedly from seat row to seat row and during phases of the flight, it is important that the screen appear sufficiently bright to satisfy the passenger's expectation.

For IFE purposes and the instant patent application, photometric terms such as brightness and luminance may be used somewhat loosely, as if interchangable, since one goal is individual passenger satisfaction, a relatively non-specific or non-quantifiable condition. Thus, brightness, in the sense of the characteristic of light that gives a visual sensation of more or less light, and luminance as a measure of the amount of light leaving a surface in a given direction (Candela/cm$^2$) may be used analogously, especially because flat panel displays are by no means lambertian radiators.

Thus, in practice, although each user will be provided with an individual brightness control on their display, the goal is to provide a satisfactory brightness most of the time in changing conditions without requiring fiddling by the passengers.

One known method for satisfying picture brightness demands is shown in Sony Japanese Patent No. TOKKOHEI 7-59061 which system interlocks the CRT luminance signal (or the back light of an LCD) with a given room's light condition. In that system, when a room's lights are powered on and the room is bright, display screen luminance is increased. Similarly, when the room lights are powered off and the room is dark, screen brightness is decreased. However, the approach used in this prior art patent does not provide a solution to maintaining acceptable perceived brightness for a series of individual monitors, especially in a complex mixture of light and dark such as found in a passenger cabin of an aircraft, a bus, etc. And, generally speaking, brightness control in CRT displays is quite different from, for example, LCD displays. Moreover, prior approaches do not take into account degradation of the brightness of an LCD display caused by time in service degradation of back light brightness.

Especially with flat panel type displays requiring back lighting, passenger perceived brightness is keyed strongly on back light performance. In general, makers of different types of back lights, such as fluorescent back lights, sell their lamps with a photometric indication of the radiant energy capable of being produced by the lamp, often known as an ideal or initial luminance. Generally, how an individual lamp's ideal luminance is described in the manufacturer's specification, as well as how the lifetime of the lamp is specified, is different from manufacturer to manufacturer. In any event, however, when the back light ceases to function or becomes unacceptably dark, its replacement is required. And, because each back light's performance degrades over time (although no two lights degrade at exactly the same rate or in the same amount) when a new back light is installed, its luminance is necessarily greater than older lamps with more time in service.

As depicted in FIG. 7*a*, for example, when a new back light (line a) is installed to replace an old back light with 10,000 hours in service, the passenger perceived luminance difference between the new light and an existing but not yet unsatisfactory light (line b) is substantial. It will be understood that because individual lights fail and degrade in substantially independent fashion, it may regularly occur that an individual passenger's display having a brand new bright back light installed will frequently be located near or adjacent to other passenger displays having older less bright back lights. As a result, a highly desirable uniformity of luminance among displays located in a common area can, as a practical matter, almost never be achieved.

As discussed above, it is clear that individual users could each control the brightness of their own screens, but this is not acceptable in view of the goal of providing a high-quality uniform service to each of the passengers with separate monitors. Moreover, the known IFE systems have system maintenance drawbacks as well. For example, the ground crew in charge of maintenance for passenger equipment on an aircraft must routinely check monitor or display appearance prior to passenger boarding. Thus, in addition to lamp replacement, it is a routine maintenance action to optimize the display system even though maintenance time is often very short given the economic impact of aircraft turnaround time. To IFE customers, i.e. airlines, the maintenance burden posed by a system is a very significant factor. Bus, train and meeting room operators similarly highly value ease of maintenance in a display system.

Thus, it will be appreciated that when each back light equipped display has a different degree of back light degradation, it would be very troublesome and time consuming for the serviceman to optimize the entire system from a service control station. It would, of course, be possible for the serviceman to individually monitor each back light's condition from a control station and then individually control each such as, for example, by using a control signal such as a voltage signal. However, it will be appreciated that as systems become larger and more complex, this option is both time consuming and troublesome. It will be understood that a primary goal of any inflight entertainment system, for example, should be to minimize maintenance requirements while providing maximum service. This invention is intended to remedy these and other disadvantages of existing IFE and other passenger entertainment or single room multi-screen display systems.

SUMMARY OF THE INVENTION

The present invention provides a back light control apparatus for back light installed for a display apparatus plurally located in the one space comprising a comparator to compare current brightness value from sensor with predetermined luminance level and a brightness controller to control brightness of said back light based on output signal from said comparator so as to limit said brightness to said predetermined luminance level when said current brightness value is higher than said predetermined luminance level.

A further aspect of this invention is a back light control method for controlling back light installed for flat display means plurally located in one space comprising the steps of: comparing current brightness value from a sensor with predetermined luminance level; and controlling brightness of said back light based on the result of said comparing step so as to limit said brightness to said predetermined luminance level when said current brightness value is higher than said predetermined luminance level.

Moreover an advantage of this invention is the provision of a display system having a plurality of display apparatus for each user equipped in common space, where each display apparatus includes a flat display able to pass light from behind; a back light for lighting said flat display from behind side so as to be watched by user from front side; a back light driver for supplying power to said back light; a sensor positioned inside of said display apparatus and located adjacent said back light for detecting current brightness value of said back light; a back light controller received said current brightness value for controlling said back light through said back light driver; said back light controller including a comparator to compare said current brightness value from said sensor with predetermined luminance level and a brightness controller to control brightness of said back light based on output signal from said comparator so as to limit said brightness to said predetermined luminance level when said current brightness value is higher than said predetermined luminance level.

These and other advantages will become more apparent by reference to the detailed description of the presently preferred embodiments, as well as drawings.

DESCRIPTION OF THE PREFERRED EMBODIMENTS

An embodiment of a back light control system according to the present invention will hereafter be explained with reference to FIG. 2.

Figure 1:
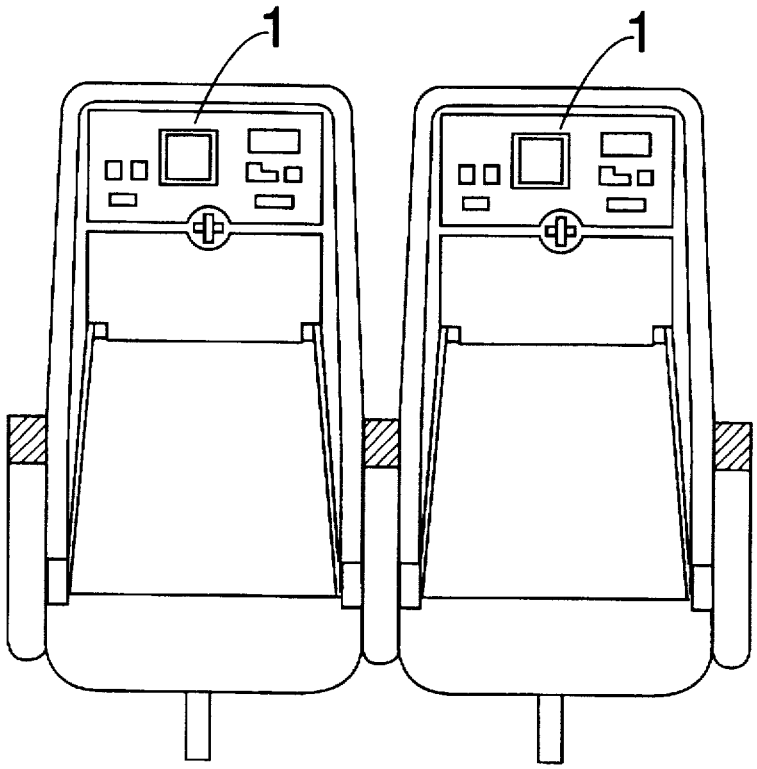
FIG. 1 is a view of two units of a known display system suitable for use with this invention, each attached to the back of a passenger seat.
Figure 2A:
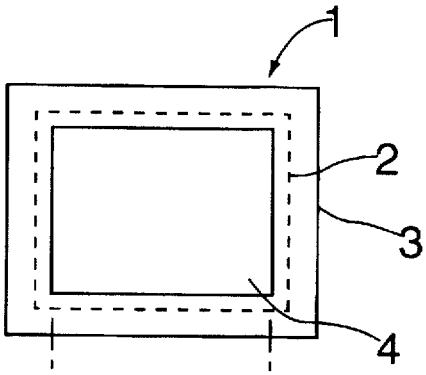
FIG. 2A is an front view of the display of this invention.

The embodiment of FIG. 2A is a front view of a display apparatus 1 with a back light. A flat panel display, such as Liquid Crystal Display (LCD) 2 is mounted in cabinet 3. The edge part of the LCD 2 is behind of the cabinet 3, and only images in effective area 4 of display 1 are visible from the user's side.

Figure 2B:
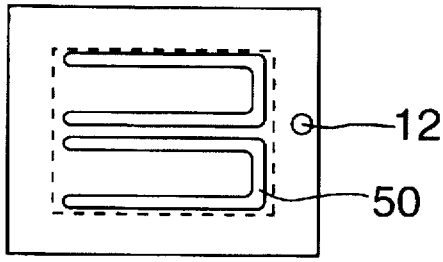
FIG. 2B is a cross-sectional front view of the display disclosed the U-shaped back light of this invention.

FIG. 2B is an inside view from front side of the display apparatus 1. U-shaped fluorescent light 50 is installed as a back light behind the LCD 2. Dot line in the figure indicates the outline of the effective area 4 of picture of LCD 2. A sensor 12 is mounted out of the area so as not to give a bad effect to the visible image. That is, it is for avoiding that user may watch the shadow of the sensor from his side. Moreover, in order to avoid causing U-shaped gradation by the back light shape, a diffusion board (not shown) is placed between the back light 50 and LCD 2. The diffusion board has an characteristic that portion of corresponding to back light has low transparency and other portion has high one.

Figure 2C:
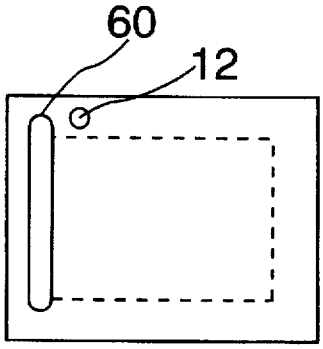
FIG. 2C is also a cross-sectional front view of the display disclosed the bar-shaped back light of this invention.
Figure 2D:
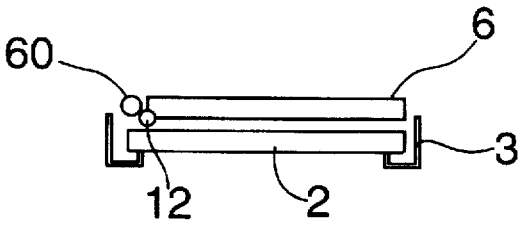
FIG. 2D is a cross-sectional side view from upper side of the display of FIG. 2C of this invention.

FIG. 2C is another embodiment of an inside view from front side of the display apparatus 1. The embodiment describes a back light 60 simple straight shaped and positioned one side of LCD 2 (called edge-light type), which has 3~4 mm diameter. According to this embodiment, when the light 60 is mounted in this position, the brightness become dark gradational from the light mounted position to far from there. In order to overcome the problem, a diffusion board 6 made by resin (such as plastic) is positioned by adhesive way as you can see in FIG. 2D. FIG. 2D is an side cross sectional view from upper side of the display of FIG. 2C. The back light 60 is positioned along the edge line of the diffusion board 6, the board is extended so as to position (be attached) behind of LCD 2. The diffusion board 6 has a characteristic that portion of close to the back light 60 has low transparency. The transparency becomes higher in proportion as the portion far from the light 60 so as to be uniform brightness given to LCD 2. The results in uniform illumination of effective picture area 4.

Each of the sensors 12 shown in FIG. 2B, 2C and 2D are positioned at least adjacent position of the back light 50 or 60. Preferably it is recommended to locate the sensor where there is little or no incident external light. But even if the sensor is located the place having an external light effect, it is not serious problem because of the back light brightness is much stronger than external light one. The sensor 12 described in FIG. 2C is also located out of the visible area 4 so as not to cause a shadow observable by user as well. It is believed that any commercially available photo sensor with acceptable size, sensitivity and temperature tolerance characteristics for a given embodiment's design is acceptable for use with this invention.

Additionally L-shaped type back light (not shown) has recently become popular. In this example, two straight shaped lights are positioned as L-shape. It needs diffusion board adapting the characteristic thereof as well, and sensor is positioned in the same idea of above mentioned.

A variety of acceptable backlights and diffusion boards are commercially available. In, for example, an 8.6" LCD used in IFE systems, an integrated assembly including the backlight, diffusion board and inverter available from Toshiba LighTech as part number BLU10WC2EX9ASY is preferred.

Figure 3:
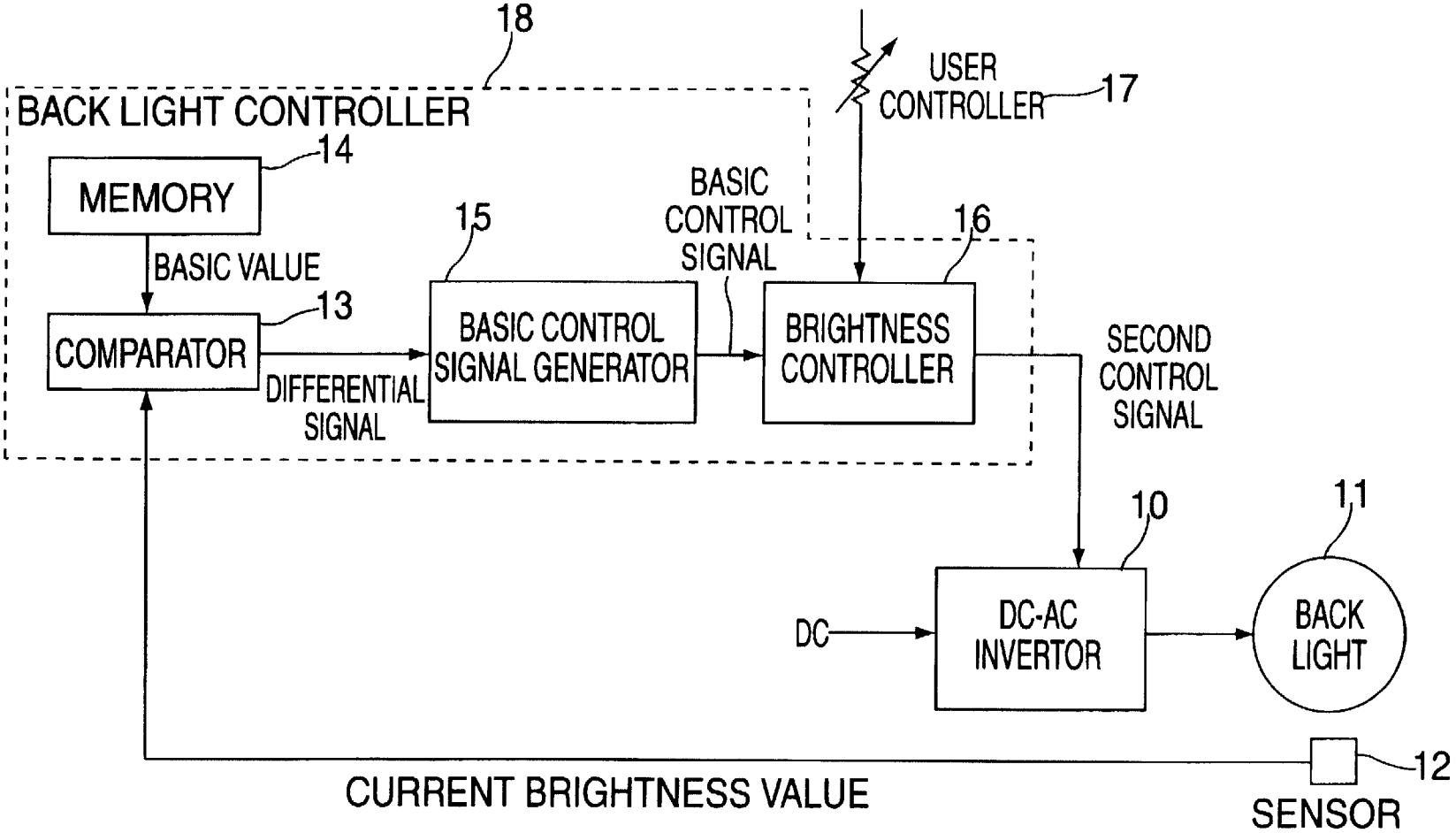
FIG. 3 is a block diagram of the back light control apparatus of this invention.

An embodiment of back light control circuit for LCD (liquid crystal display) is described in FIG. 3. Back light 11 is lighted by DC-AC Invertor 10 as a back light driver which converts DC power to AC power. Actually 400 Hz AC power is provided for most aircraft equipments, but the AC power is converted to DC power when the power is provided to the seats in view of safety considerations. Thus, DC-AC Invertor 10 converts the DC power again to AC power so as to be appropriate voltage for fluorescent light such as several hundred volt.

Light sensor 12 detects the brightness of the back light 11 and outputs present brightness value. The present brightness value is sent to back light controller 18. The back light controller 18 is composed of comparator 13, memory 14, basic control signal generator 15 and brightness controller 16. The comparator 13 can be comprised in not only hardware logic circuit but software as a part of function of CPU and so on. Said brightness value is sent to the comparator 13 in the back light controller 18 to compare with reference value from memory 14. The reference value is predetermined and stored at factory or service man of aircraft according to the type of light source equipped on. For example, on occasion of full brightness level (ideal luminance) of the light source is 100, the stored reference value is 70. The value is decided in accordance with the light source type, required limited brightness and so on. The memory 14 is possibly comprised in not only, so called hardware circuit, such as RAM, capacitor, or software as one function of CPU, but also much simple way, for example, variable resistance connected power supply. In this case, said service man or said factory is able to preset the predetermined reference value by adjust the variable resistance manually in advance. Of course, in case of the memory 14 comprising a micro computer chip, the predetermined reference value would be able to preset and change from host control center in the aircraft.

Preferably, comparator 13 compares preset reference value from memory 14 and the present brightness value from light sensor 12. As a result, a differential signal is generated. The differential signal is supplied to basic control signal generating circuit 15. The basic control signal generating circuit 15 generates basic control signal based on the differential signal from comparator 13. When the differential signal is input to the generator 15, suppressing level is calculated in the generator 15. The suppressing level means attenuation value in order to reach predetermined brightness level, such as 70(%) of said full level. For instance, if the difference value from comparator 13 is 30, that means detected brightness value is 100, the basic control signal is generated so as to attenuate brightness by 30%. If the difference value from comparator 13 is equal or under zero, that means detected brightness value is the same or less than predetermined value, then the basic control signal is not generated because of present back light brightness is satisfied. Otherwise, the basic control signal is generated, but the generated signal means the detected present brightness is the same or lower than 70%. Of course, because these are just examples, we can choose another reference value. In the case, when the comparator 13 obtains difference signal between 0 to 30, the basic control signal generating circuit 15 generates basic control signal based on calculated attenuation value. When the difference signal more than 30, the generating circuit 15 does not generate the control signal. These variation can be chosen easily by engineers ordinarily skilled. The basic control signal generator is also able to be comprised in not only hardware logic circuit but software as a part of function of CPU and so on.

The user controller 17 is a variable control adjustment equipped for user who is watching the flat display monitor. Usually the dial (or up-down key) is formed on the casing of the monitor so as to be operated by user manually. User controller 17 is possibly formed by hardware logic circuit, such as variable resistance, 1 chip IC with flip flop and so on. Of course it can be software as a part of function of CPU. The user control signal generated from the user controller 17 is supplied to brightness controller 16. The brightness controller 16 generates second control signal based on the user control signal and the basic control signal. If the basic control signal exists or if the basic control signal means the present brightness value is higher than 70% of the ideal luminance, the second control signal is generated based on the user control signal and the basic control signal for attenuating the back light brightness. The brightness controller 16 outputs the second control signal attenuated by the basic control signal as a base data. If not, the user control signal itself is only supplied to DC-AC Invertor 10 as the second control signal, said base data is following said present brightness value. The brightness controller 16 can be comprised in not only hardware logic circuit but software as a part of function of CPU and so on. Moreover the brightness controller 16 is possibly formed a part of a back light driver (DC-AC Invertor 10). That means, DC-AC Invertor 10 is able to have a function of the brightness controller 16, the second control signal is communicated inside of the DC-AC Invertor 10. The DC-AC Invertor 10 is controlled by the second control signal so as to change output which is converted from DC input. Furthermore, DC-AC Invertor 10 is possibly composed of whole back light controller 18 when integrated micro controller (such as LSI) is supplied. In that case, all functions of back light controller 18 can be driven by software in the LSI. As a result, the brightness of the back light 11 is controlled based on the control signal.

Figure 6:
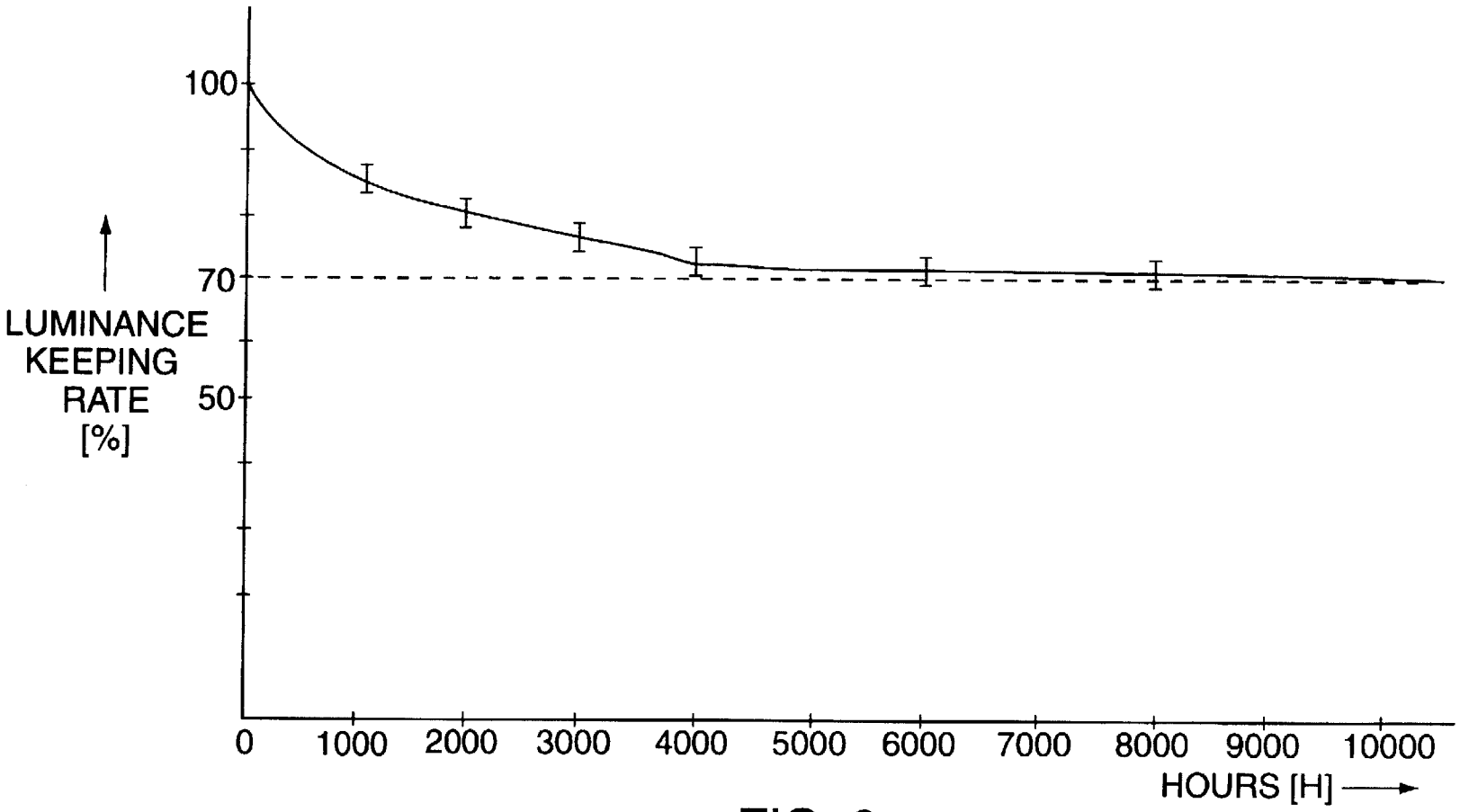
FIG. 6 is a graph of one example for the luminance changing characteristic of general back light.

The back light, such as fluorescent light does not keep uniform brightness for long time continuously. FIG. 6 shows a graph for characteristic of U-shaped fluorescent back light luminance keeping rate for a 8.6-inch Sony LCD monitor. This data was measured in conditions of room temperature 25°±3° C., and displays the average of three points. According to this graph, it can be seen that the luminance decreases according to passage of time. The luminance keeping rate 100% indicates an ideal luminance as described in specs of the light. In the beginning period, about 1000 hours after start to use, the luminance decreases rapidly. After that, the decrease slows, and at about 10,000 hours after start of use, it reaches approximately 70%.

Generally, the useful life time of a fluorescent light varies by each type and each maker. How to specify the bulb's life time varies by manufacturer as well. However, generally speaking, when the luminance becomes 50% of ideal luminance, it becomes unfit for the expected visible quality of the image of LCD.

Figure 4:
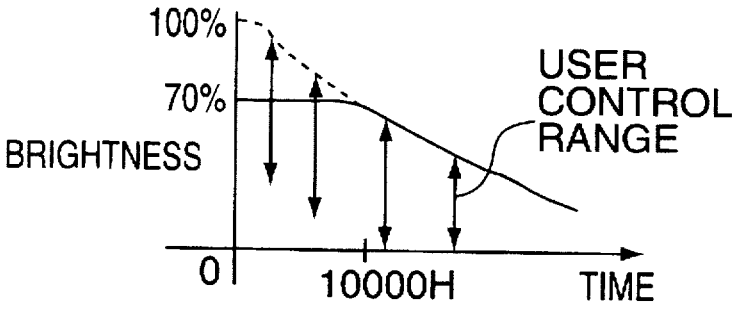
FIG. 4 is a graph for explaining user control range of this invention.

The example of the user control range applied this invention is shown in FIG. 4. As you can see in the figure, a user is able to control the brightness of LCD (back light 11) on user's choice by user controller 17. The control range is limited according to the degraded maximum value based on time spending. In this example, the base data until 10000 hours is 70% of said ideal luminance (100%). The base data which is the attenuated brightness indicates a basic brightness defined so as to be the same brightness of all back lights located said discrete one space. As you can see in this figure, even though the brightness is attenuated to the base data (70%), back light 11 is able to be controlled to possible maximum brightness (for example, when the back light is brand new, the maximum brightness is the ideal brightness) by user controller 17.

Figure 5:
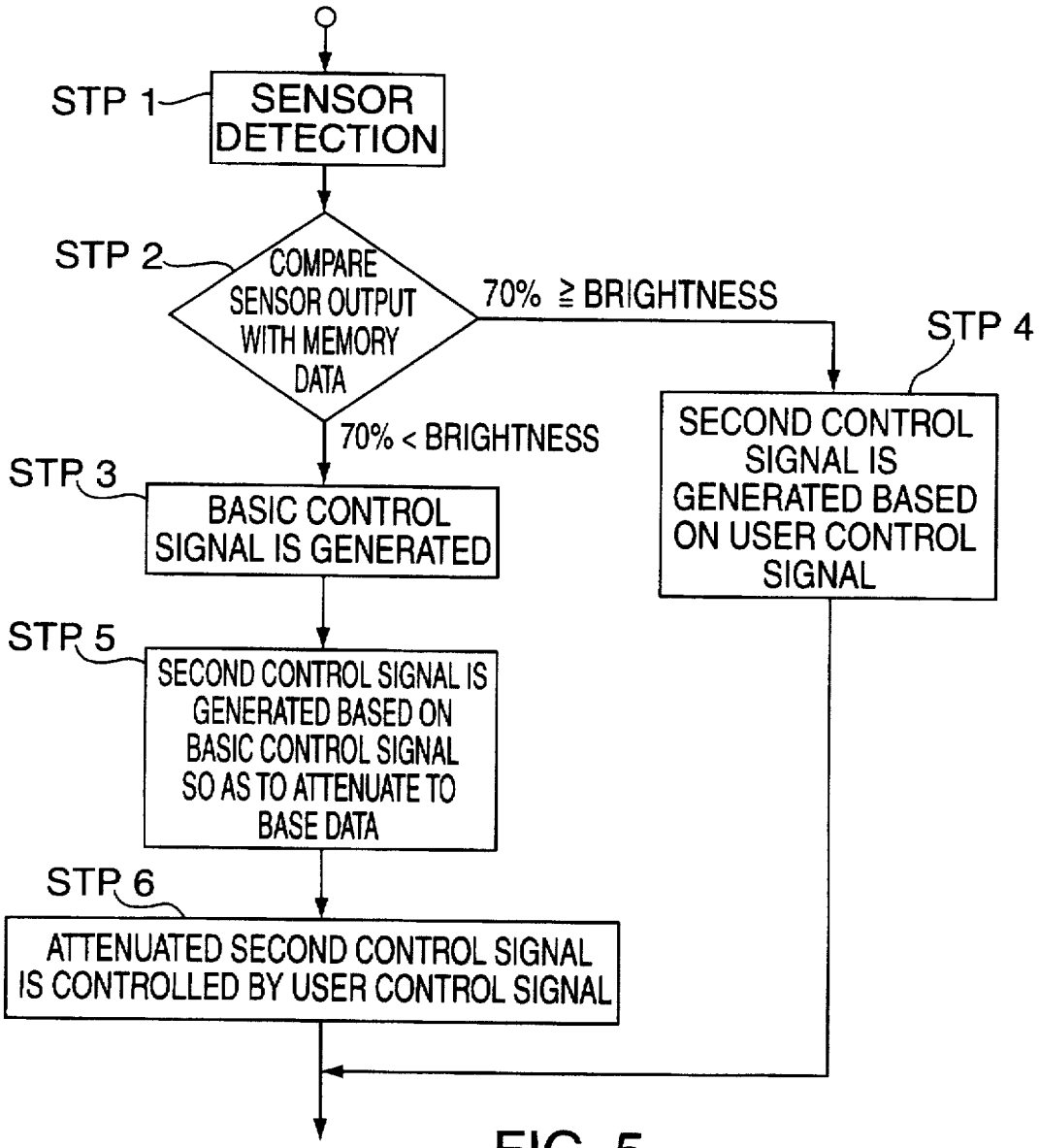
FIG. 5 is a flow chart of the back light control system of this invention.

The embodiment of flow chart described in FIG. 5 for the back light control acting in back light controller 18. The back light controller 18 is possibly composed by micro control circuit, such as CPU, the steps are processed as follows.

When back light controller 18 receives present brightness value detected by sensor 12 (STP1), the present brightness value is compared with memory data stored in memory 14 (STP2). When the result of STP2 appears, controlling step (STP3, STP4, STP5, STP6) comes next. In occasion of the detected brightness is higher than threshold (in this example, threshold is 70% of said ideal brightness), basic control signal is generated based on differential value between them (STP3). The basic control signal is for generating second control signal for back light brightness which is attenuated based on the present brightness value. When the basic control signal is generated, the second control signal is generated based on said basic control signal and user control signal from user controller 17 (STP5, STP6). In STP5, the second control signal is attenuated to said base data by said basic control signal. When user controller 17 is operated by user, the second control signal is also controlled by the user control signal (STP6). This circumstance is described in FIG. 4 as mentioned above, even though the second control signal is attenuated to the base data, back light 11 is able to be controlled to possible maximum brightness by user controller 17.

If the detected brightness is equal or weaker than 70% of said ideal brightness in STP 2, second control signal is generated based on user control signal from the user controller 17 (STP4). In this case, shown in FIG. 4, maximum brightness by user controller 17 is the same as degraded possible maximum brightness. As mentioned above, brightness of the back light is controlled according to second control signal generated in back light controller 18.

Figure 7A:
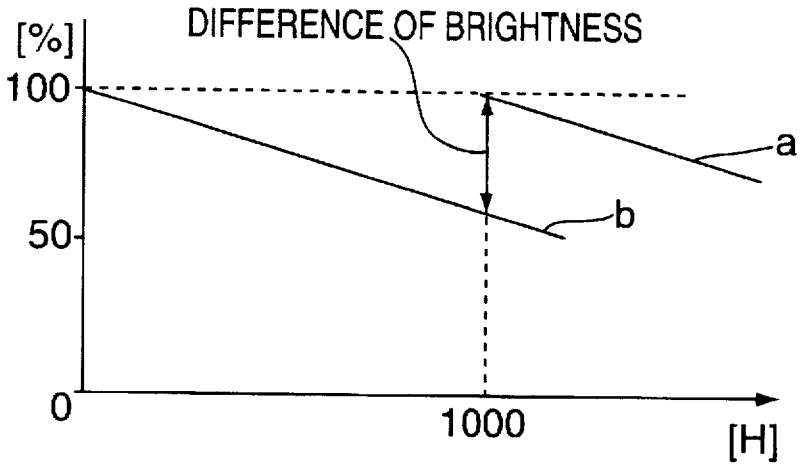
FIG. 7A is a graph for explaining the difference of luminance between existing back light and re-installed back light of the back ground of the prior art.
Figure 7B:
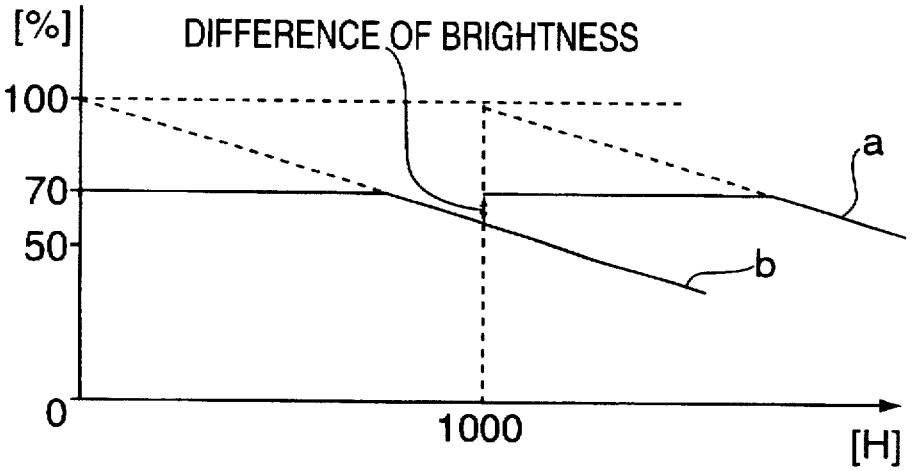
FIG. 7B is a graph for explaining the difference of luminance between existing back light and re-installed back light of this invention.

As a result, as you can see in FIG. 7B, even if new back light is installed, the difference of brightness between new light and old one can be kept small. Normally when the back light brightness becomes lower than 50% of new one, the back light becomes an object for replacement. Therefore, the difference between a back light become lower than 70% brightness and attenuated back light to 70% is not serious problem in this invention.

In the above example, the present brightness value is one of the basis to replace the back light. Elapsed time is available as well. For instance, when 10000 hours has passed after installation, it becomes an object for replacement. One rule of thumb is that consumer products are typically used five hours per day in five years. Of course, use in passenger entertainment systems will vary with the transport means, between long haul aircraft routes and, for example, local bus or train services. However, those experienced in passenger entertainment use similar maintenance rules of thumb. Because of the life time of fluorescent light varies by type, manufacturer and so on, it depends on the situation, such as circumstance and requirement of serviceman. Preferably 10000 hours is one of the recommended period. Actual time in use can also be easily obtained, and may provide another useful measure.

The embodiments described above have been explained that threshold (attenuated level) is 70% of ideal brightness of new light, but the variation can, in practice, be applied as between about 60% and about 80% of ideal luminance. The degradation for fluorescent light has variation depending on the type of light, manufacturer, dispersion for each. If cold cathode lamp is used, the useful life time will be longer. Accordingly, the percentage of ideal luminance to be used as the predetermined level should be decided as discussed above.

Moreover, although the display system is mainly described the type of display mounted on the seat in this embodiment, it, of course applies, for example to a display mounted on the armrest and popped up from the armrest.

Furthermore, the display system can apply various types of back light, not only fluorescent light but also electroluminescence lamp and so on. And the flat panel display is not limited only to LCDs, other types of flat display which need back light, in other words, which enable to pass light lighted up from the behind, such as plasma display are also adapted for use with this invention.

Finally, the present invention is able to apply not only aircraft but also the other types of single discrete spaces, such as train, bus, passenger boat, personal movie theater, conference room, and so on.

Although several embodiments of this invention have been described, it will be apparent that many modifications and variations on the described embodiments could be one skilled in the art without departing from the spirit or scope of this invention, as claimed below.

What is claimed is:

1. A back light control apparatus, for a back light installed in one of a plurality of display apparatus forming a system co-located in discrete space, comprising:

a sensor arranged to detect only a brightness value of light produced by said back light;

a comparator to compare a detected brightness value from said sensor with a predetermined system luminance level and producing a control signal only when the detected brightness value is greater than or equal to said predetermined system luminance level;

a user controller manually operated by a user for generating a user control signal; and a brightness controller for controlling brightness of said back light based on said control signal from said comparator and on said user control signal from said user controller so as to control said brightness based only on said user control signal when said detected brightness value is higher than said predetermined luminance level, thereby producing substantial uniformity of perceived brightness among said plurality of co-located display apparatus.

2. The back light control apparatus according to claim 1, further comprising; a memory storing said predetermined system luminance level for supplying said predetermined system luminance level to said comparator.

3. The back light control apparatus according to claim 1, wherein said sensor is positioned inside of said display apparatus and located adjacent said back light so as to detect only a brightness value of the light from said back light.

4. The back light control apparatus according to claim 3, wherein said display apparatus including flat display, said sensor is located behind and out of visible area of said flat display.

5. The back light control apparatus according to claim 1, wherein said comparator comprises: a basic control signal generator for generating said control signal, wherein said comparator produces a differential between said detected brightness value and said predetermined system luminance level used by said basic control signal generator to generate said control signal fed to said brightness controller.

6. The back light control apparatus according to claim 1, wherein: said predetermined system luminance level is approximately seventy percent of ideal luminance of said back light.

7. A back light control circuit for controlling a single back light illuminating one of a plurality of flat display means located in one space, to increase display uniformity among said plurality of display means independent of back light usage age, said control circuit comprising:

a sensor arranged to detect only a brightness value of light produces by said back light;

means for comparing a detected brightness value received from said sensor with a predetermined luminance level assigned to all said display means located in said space independent of back light usage age or ambient conditions and producing a control signal only when the detected brightness is equal to or greater than said predetermined luminance level, said predetermined luminance level being between 60% and 70% of ideal luminance level of said back light;

a user controller for operation by a user for generating a user control signal; and means for controlling a brightness of said back light based on said control signal from said comparing means and on said user control signal so as to control said brightness of said back light based only on said user control signal when said detected brightness value is higher than said predetermined luminance level.

8. The back light control circuit according to claim 7, further comprising:

means for storing said predetermined luminance level and for supplying said predetermined luminance level to said compare means.

9. The back light control circuit according to claim 7, wherein: said predetermined luminance level is approximately seventy percent of ideal luminance of said back light.

10. A method of controlling an individual flat panel display apparatus back light, in a system comprising a plurality of displays located in a discrete space, comprising the steps of:

setting a predetermined system luminance level;

sensing only a brightness value of an individual back light:

comparing an individual back light sensed brightness value with said predetermined system luminance level and producing a control signal only when the sensed brightness value is equal to or greater than said predetermined system luminance level;

generating a user control signal from a manually operated user control; and controlling the brightness of said individual back light based on the control signal produced in said comparing step so as to control said brightness based only on said user control signal when said present brightness value is higher than said predetermined luminance level to substantially ensure uniformity among said plurality of displays.

11. The back light control method according to claim 10, wherein said predetermined system luminance level is approximately seventy percent of ideal luminance of said back light.

12. A display system having a plurality of individual passenger display apparatus in a common space, each said display apparatus comprising:

a flat display which enables to pass light lighted up from the behind;

a back light for lighting said flat display from behind so as to be watchable by a user from front side;

a back light driver for supplying power to said back light;

a back light brightness value sensor positioned inside of said display apparatus and adjacent said back light for detecting only light produced by said back light;

a back light controller operatively coupled to said sensor and to said back light through said back light driver, said back light controller comprising;

a user controller manually operated by a user for generating a user control signal;

a comparator connected to said sensor to receive said back light brightness value from said sensor and a predetermined system luminance value and producing a control signal only when the detected brightness value is greater than or equal to said predetermined system luminance value; and a brightness controller for controlling brightness of said back light based on said control signal from said comparator and on said user control signal so as to control said brightness based only on said user control signal when said present brightness value is higher than said predetermined system luminance value.

13. The display system according to claim 12, said back light controller further comprising a memory storing said predetermined system luminance value for supplying said predetermined system luminance value to said comparator.

14. The display system according to claim 12, wherein said sensor is located outside of a visible area of said flat display.

15. The display system according to claim 12, wherein said predetermined system luminance value is approximately seventy percent of ideal luminance of said back light.

* * * * *